US005086572A

United States Patent [19]

Lee

[11] Patent Number: 5,086,572

[45] Date of Patent: Feb. 11, 1992

[54] SELF-VENTILATING SHOE

[76] Inventor: Kuyn C. Lee, Taepyungyang Apt. 6-405, 1774-1 Daeyun 6-Dong, Nam-Ku, Pusan, Rep. of Korea

[21] Appl. No.: 574,102

[22] Filed: Aug. 29, 1990

[30] Foreign Application Priority Data

Sep. 12, 1989 [KR] Rep. of Korea ..... 89-13599

[51] Int. Cl.[5] ..... A43B 7/06

[52] U.S. Cl. ..... 36/3 R; 36/3 A; 36/3 B

[58] Field of Search ..... 36/3 A, 3 B, 3 R

[56] References Cited

U.S. PATENT DOCUMENTS

| | | | |
|---|---|---|---|
| 682,182 | 9/1901 | Ellings | 36/3 A |
| 1,211,542 | 1/1917 | de L. Carolin | 36/3 R |
| 1,259,229 | 3/1918 | Hagstrom | 36/3 A X |
| 1,971,223 | 8/1934 | Kamrass | 36/3 A |
| 2,027,757 | 1/1936 | Whitfield et al. | 36/3 B |
| 2,190,802 | 2/1940 | Powell | 36/3 A |
| 2,437,065 | 3/1948 | Austin | 36/3 R |
| 2,480,035 | 8/1949 | Lindstrom | 36/3 R |
| 2,591,454 | 4/1952 | Manning | 36/3 A |
| 2,701,923 | 2/1955 | Toman | 36/3 R |
| 4,654,982 | 4/1987 | Lee | 36/3 B X |

FOREIGN PATENT DOCUMENTS

| | | | |
|---|---|---|---|
| 90-9004 | 9/1990 | Rep. of Korea . | |
| 376 | 10/1885 | Sweden | 36/3 A |

*Primary Examiner*—David T. Fidei
*Assistant Examiner*—BethAnne Cicconi
*Attorney, Agent, or Firm*—Birch, Stewart, Kolasch & Birch

[57] ABSTRACT

A shoe ventilation system which includes an upper having an air inlet and an air outlet disposed in the upper portion thereof, respectively, and a one-way air flowing member disposed in the lower portion thereof, an inner sole having a plurality holes in the sole portion thereof and a plurality of channels and an arch extended portion disposed in the bottom surface thereof for communicating with the air flowing member, whereby the interior of the shoe can be continuously ventilated.

5 Claims, 6 Drawing Sheets

SELF-VENTILATING SHOE

BACKGROUND OF THE INVENTION

1. Field of the Invention

The present invention relates to a self-ventilating shoe and more particularly, to a shoe which includes an upper having an air inlet and an air outlet disposed in the upper portion thereof, respectively, and a one-way air flowing member disposed in the lower portion thereof, an inner sole having a plurality holes disposed in the sole portion thereof and a plurality of channels and an arch extended portion disposed in the bottom surface thereof for communicating with the air flowing member, whereby the interior of the shoe can be continuously ventilated.

2. Description of the Prior Art

Presently known ventilated shoes comprises elastomeric and resilient pads which are made of soft materials such as sponge or rubber and contain a plurality of holes in the sole and in the heel of the shoe in order to increase foot comfort. In these types of insoles, it is very difficult to remove moisture and the odor produced as a result of moisture which collects in the shoe due to foot sweating caused by poor shoe ventilation. Since most people use their shoes for long periods of time, it is essential to properly maintain and ventilate the shoes in order to avoid foot diseases, such as for example, water-eczema.

According to a report of the American Podiatry Association, 75 percent of the males and females stand or walk for 4 hours a day. Such foot stress leads to foot problems, particularly in males where athlete's foot fungi and the odor associated therewith have become a common problem.

In order to avoid such problems, the present inventor's inventions are also prosecuting Korean Patent Application Serial Nos. 86-21,248 and 87-17,981 which disclose a ventilated military shoe which includes lower, middle, and inner soles for introducing air and a heel portion for discharging air, respectively. However, these shoes are very difficult in construction, expensive to manufacture, and not effectively ventilate.

SUMMARY OF THE INVENTION

Accordingly, it is an object of the present invention to provide a shoe ventilation system which is effective in providing a circulation of air within the shoe while it is in use.

Another object of the present invention is to provide a shoe which includes an upper having an air inlet and an air outlet disposed in the upper portion thereof, respectively, and an one-way air flowing member disposed in the lower portion thereof and an insole having a plurality of apertures in the sole portion for leading to the interior of the shoe and a plurality of channels which connects the one-way air flowing member with the sole aperture.

It is a further object of the present invention to provide a shoe ventilation system for military shoes, sport shoes, working shoes, boots, and the like, for removing moisture and foot odor from the shoe while it is being worn thereby reducing the occurrence of foot disease.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention comprises a shoe ventilation system which includes an upper having an air inlet and an air outlet disposed in the upper portion thereof, respectively, and a one-way air flowing member disposed in the lower portion thereof, an inner sole having a plurality holes in the sole portion thereof and a plurality of channels and an arch extended portion disposed in the bottom surface thereof for communicating with the air flowing member, whereby the interior of the shoe can be continuously ventilated.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
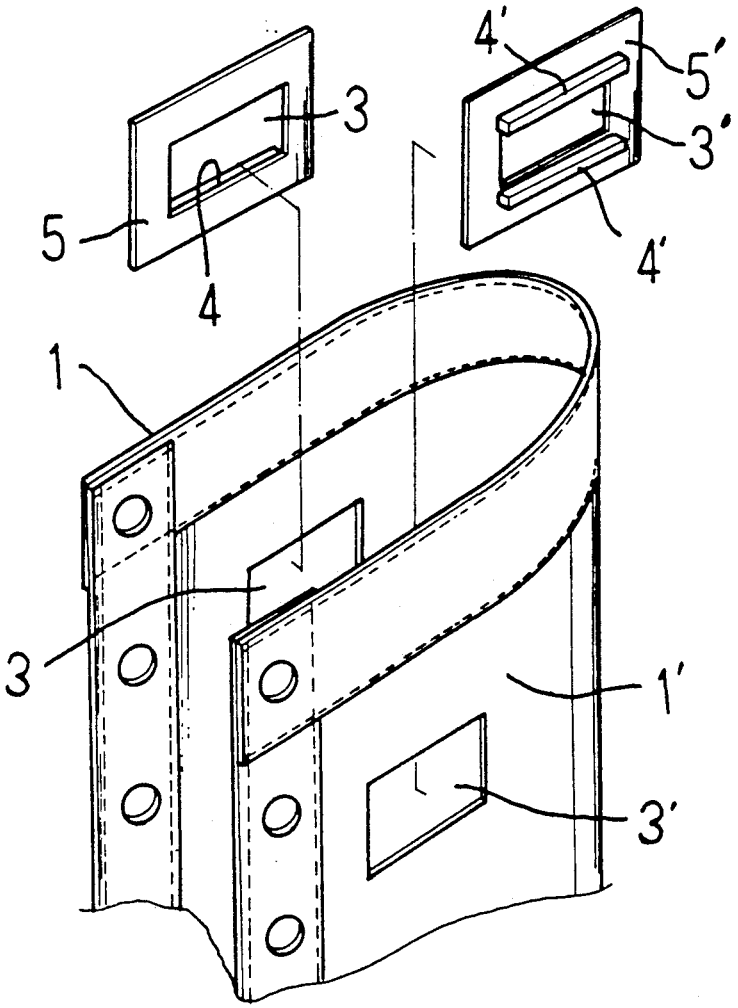
FIG. 1 is an exploded perspective view of the shoe upper according to the present invention.

Referring now in detail to the drawings for the purpose of illustrating preferred embodiments of the present invention, the self-ventilating shoe as shown in FIGS. 1, 7, 8, and 13 comprises an outer upper 1 and an inner upper 1' having an air inlet 3 and an air outlet 3' disposed in the upper portion thereof in the opposite side to each other, an air inlet plate member 9 and an air outlet plate member 10 attached to the outer upper 1 and the inner upper 1' in the opposite side to each other, an one-way air flowing member 20 disposed in the lower portion of the inner upper 1', and an inner insole 27 having a plurality of insole apertures 26, and a plurality of discharging channels 23 and an arch extended portion 24 disposed in the bottom surface thereof for communicating with the air flowing member 20. The air inlet 3 and outer 3' have a rectangular configuration, respectively.

Figure 2:
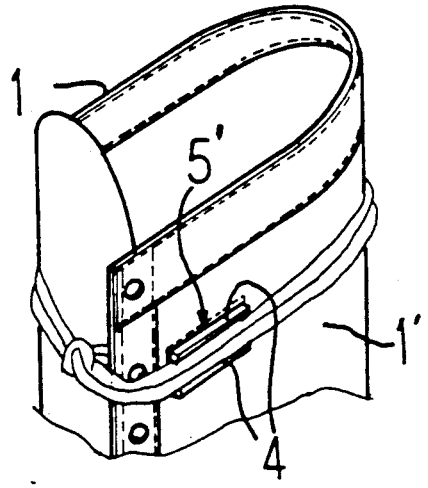
FIG. 2 is a perspective view of the shoe upper showing in a position which the air inlet and an air outlet are closed by a shoelace according to the present invention.

As shown in FIGS. 1 and 2, the air inlet and outlet 3 and 3' are disposed in air inlet and outlet bodies 5 and 5' and provided with a pair of raised portions 4 and 4' disposed in parallel and supported on both upper and lower end lines thereof, respectively, for freely passing a shoelace 2 along the rectangular air inlet 3 and outlet 3' and between the pair of raised portions 4 and 4' so as to close the inlet 3 and outlet 3' in the water such as river, riverlet, and the like. The air inlet and outlet bodies 5 and 5' are attached to the outer upper 1 in the opposite side to each other by sewing them to the outer upper 1, respectively.

Figure 3:
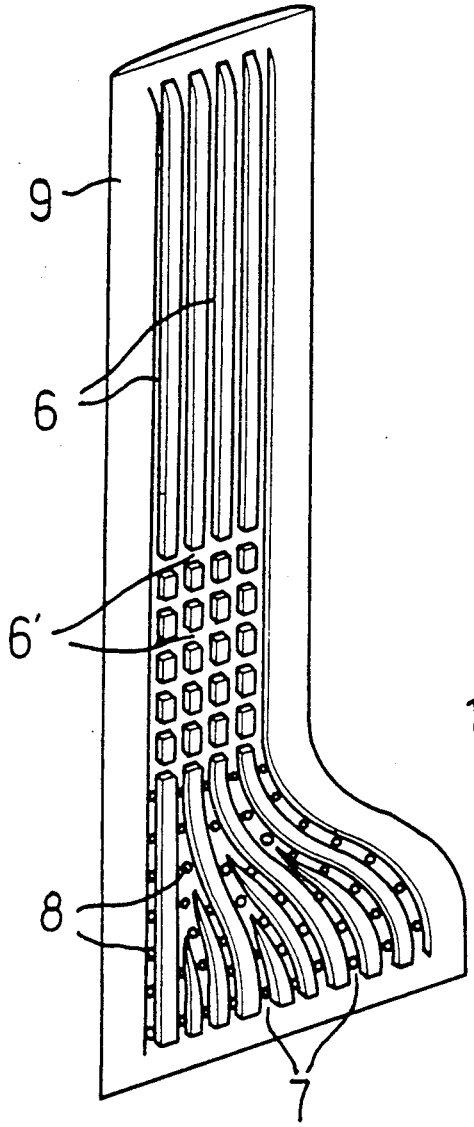
FIG. 3 is a perspective view of an air inlet plate member according to the present invention.

The air inlet plate member 9 includes a plurality of inlet vertical channels 6 disposed in the upper portion, a plurality of inlet cross channels 6' disposed in the middle portion, and a plurality of inlet radial channels 7 and inlet apertures 8 disposed in the low portion thereof for introducing the air flowed from the air inlet 3 to the interior of the shoe (FIG. 3).

Figure 6:
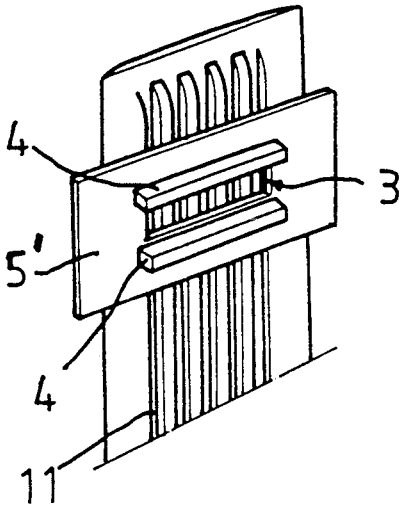
FIG. 6 is a perspective view of the air outlet attached to the upper portion of the air outlet plate member according to the present invention.
Figure 5:
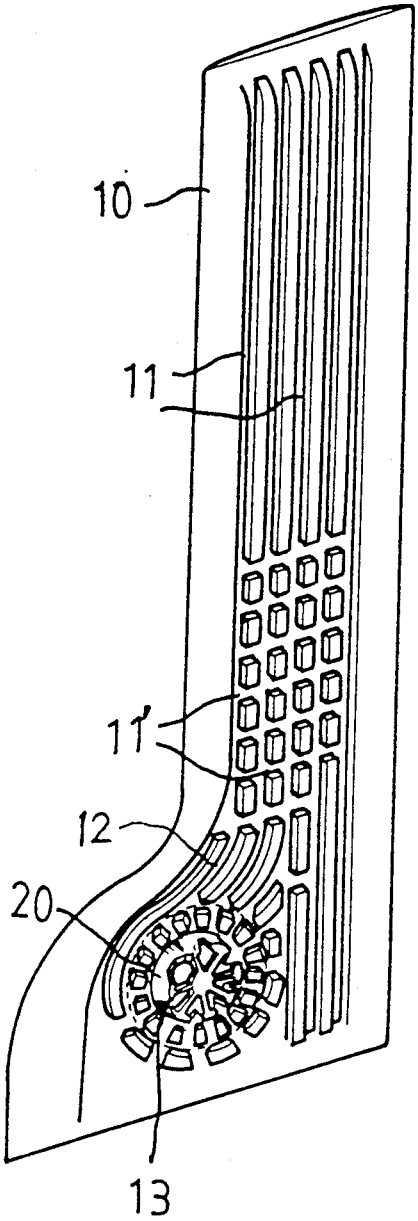
FIG. 5 is a perspective view of an air outlet plate member according to the present invention.
Figure 7:
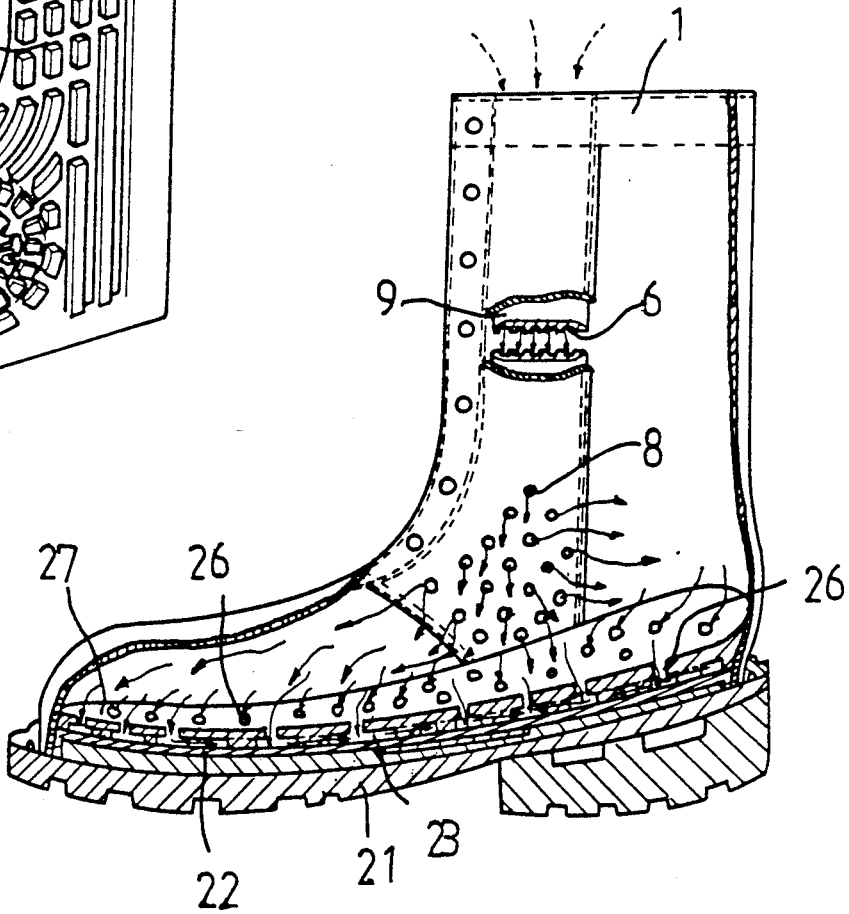
FIG. 7 is a front view of the shoe according to the present invention containing cut away portions in order to illustrate the introduction of air in the shoe.
Figure 8:
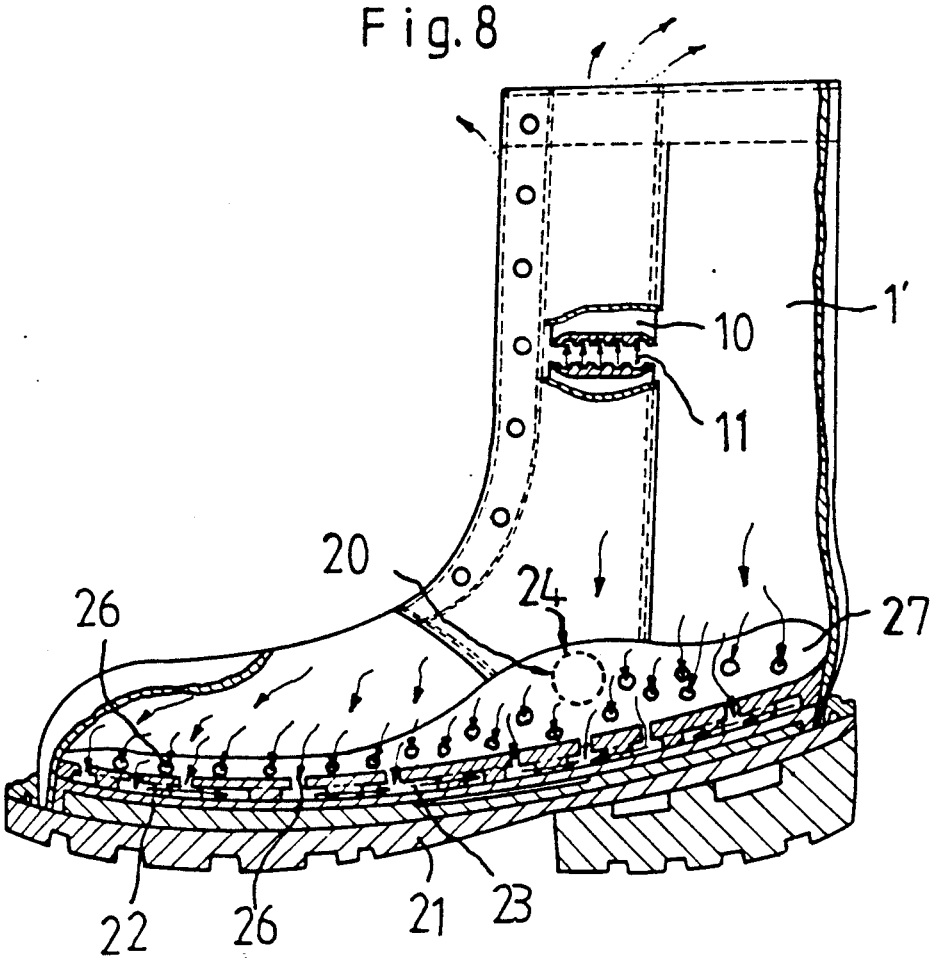
FIG. 8 is a front view of the shoe according to the present invention containing cut away portions in order to illustrate the discharge of air in the shoe.

As shown in FIGS. 5 and 6, the air outlet plate member 10 includes a plurality of outlet vertical channels 11 disposed in the upper portion, a plurality of outlet cross channels 11' disposed in the middle portion, and a plurality of outlet radial channels 12 and outlet apertures 13 for discharging the air from the interior of the shoe to the one-way air flowing member 20. At this time, the air inlet 3 is communicated with the plurality of outlet vertical channels 11 for effectively discharging the air from the one-way air flowing member 20 to the atmosphere (FIG. 6).

Figure 4A:
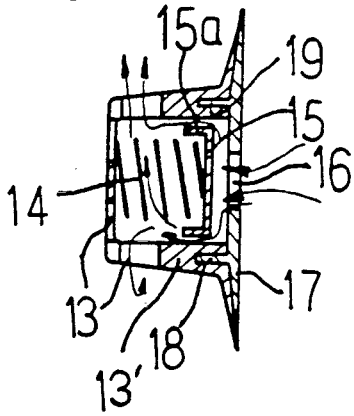
FIG. 4(A) is a sectional view of an one-way air flowing member in an open position.
Figure 4B:
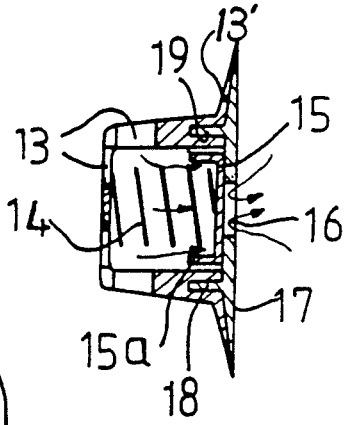
FIG. 4(B) is a sectional view of the one-way air flowing member in a closed position.
Figure 9:
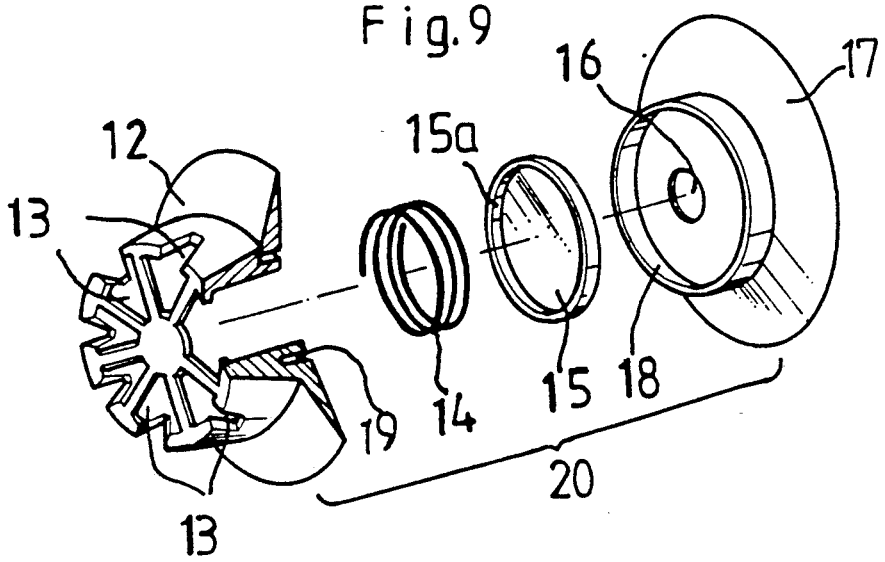
FIG. 9 is an exploded perspective view of the one-way air flowing member according to the present invention.
Figure 10A:
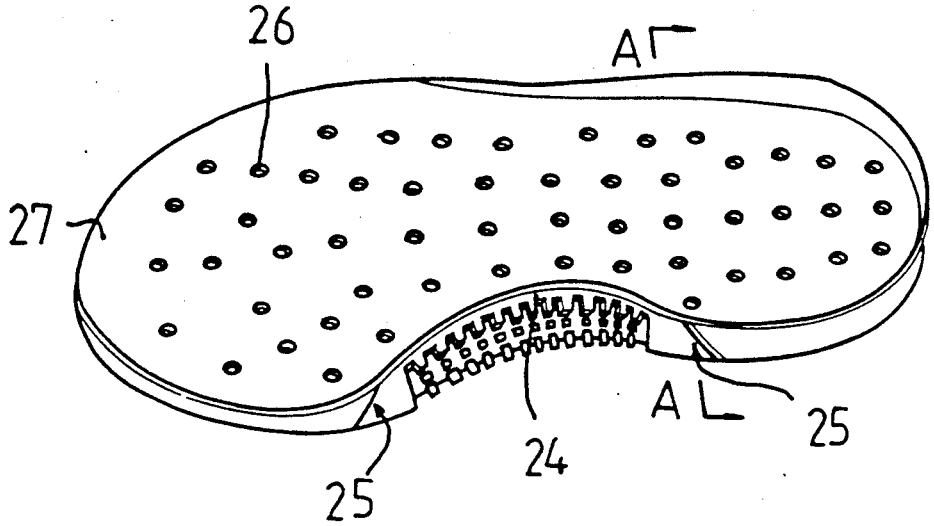
FIG. 10(A) is a perspective view of the top surface of an inner sole according to the present invention.
Figure 10B:
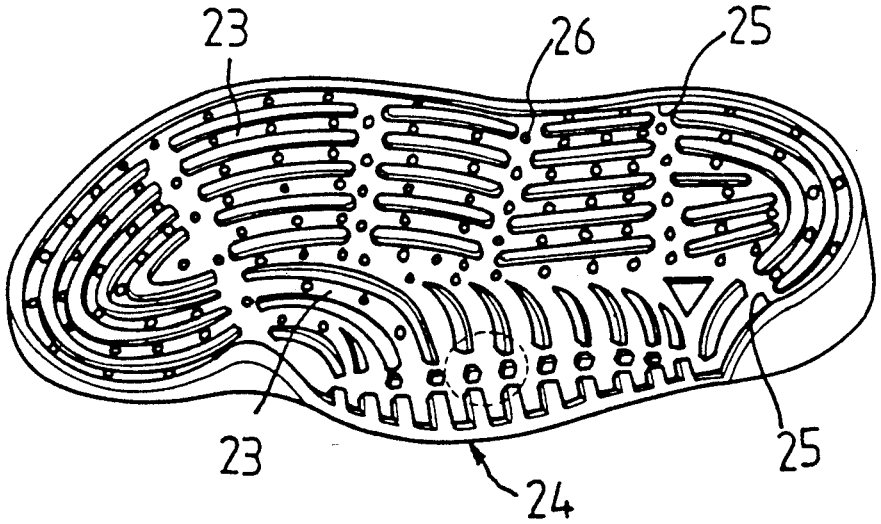
FIG. 10(B) is a perspective view of the bottom surface of the inner sole according to the present invention.
Figure 11:
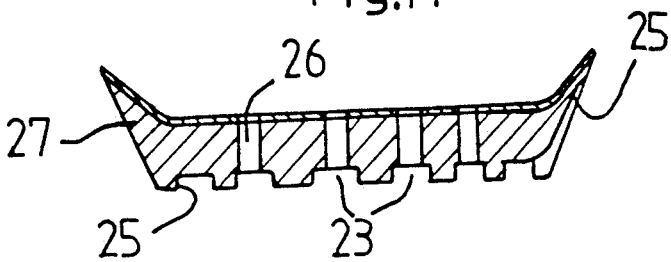
FIG. 11 is a sectional view of FIG. 10(A), taken along line A—A.
Figure 12:
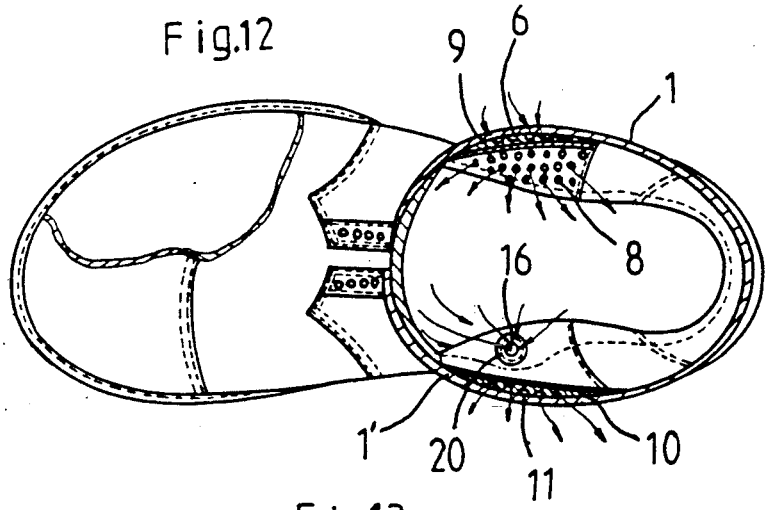
FIG. 12 is a cross-sectional view of the shoe according to the present invention showing the shoe leg without the inner sole.
Figure 13:
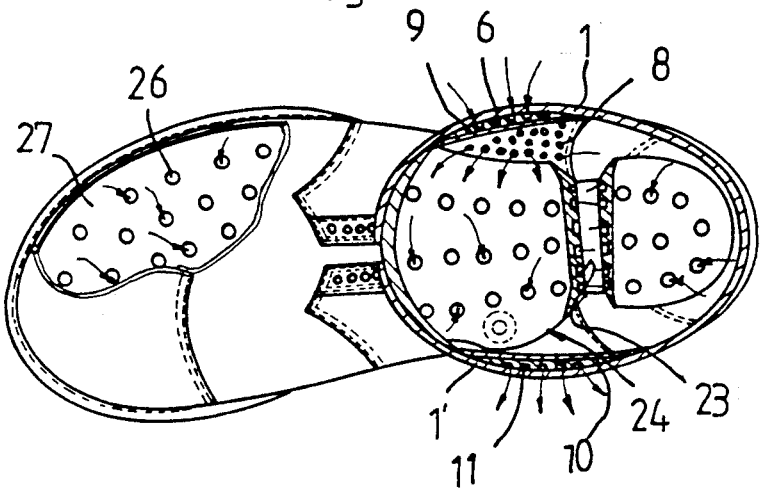
FIG. 13 is a cross-sectional view of the shoe according to the present invention showing the shoe leg with the inner sole.

As shown in FIGS. 4(A), 4(B), and 9, the one-way air flowing member 20 includes a hollow one-way body 13' having the plurality of outlet apertures 13 and a circular slot 19, a spring 14 disposed in the hollow portion of one-way body 13', a circular air valve 15 having a raised ring 15*a* disposed around the circumferential edge of the air valve 15, and a cover 17 having an air discharging aperture 16 disposed in the center thereof and a circular raised ring 18 extended from the cover 17 for slidably receiving the air valve 15 therein and inserting into the circular slot 19 of the one-way body 13', whereby the air valve 15 is slidably moved forwardly and backwardly by biasing the spring 14. Thus upon stepping on the ground, when the force of flowing air passed through the discharging aperture 16 and flowed from the interior of the shoe is pushed the air valve 15, the air valve 15 is in an open position and the waste air is ventilated to the atmosphere through the outlet apertures 13, the outlet radial channels 12, the outlet cross channels 11', the outlet vertical channels 11, and the air outlet 3 as shown in FIGS. 4(A), 5, 8, and 14.

On the other hand, upon taking off the ground, when the vacuum is created in the interior of the shoe, the air valve 15 is in a closed position and the fresh air is introduced into the interior of the shoe through the air inlet 3, the inlet vertical channels 6, the inlet cross channels 6', the inlet radial channels 7, and the inlet apertures 8 as shown in FIGS. 3, 4(B), 7, and 14.

Figure 14:
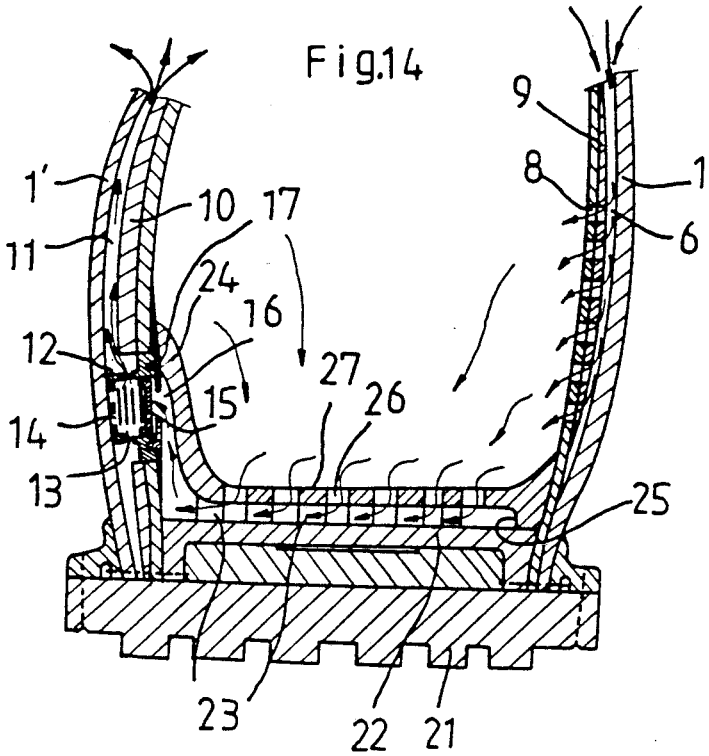
FIG. 14 is a sectional view of the shoe according to the present invention showing the ventilation of air in the shoe.

As shown in FIGS. 10(A), 10(B), 11, 12, and 13, the inner sole 27 includes the arch extended portion 24 having a stopping portion 25 for preventing the air passed through the insole apertures 26 from returning to the inlet apertures 8 (FIG. 14). Upon assembling the inner sole 27, a middle sole 22, and a lower sole 21, the arch extended portion 24 is mating with the one-way air flowing member 20 so that the air passed through the plurality of apertures 26 is flowed to the one-way air flowing member 20 to be discharged from the shoe.

The operation of the self-ventilating shoe of the present invention is as follows:

When the wear of the shoe places the heel thereof against the ground in taking a step, the inner sole 27 is compressed and the air is pushed the air valve 15 from the discharging channels 23 and the air valve 15 is in the open position and the air is discharged to the atmosphere through apertures 16 and 13, and through channels 12, 11' and 11, and through the air outlet 3'. The air valve 15 can be a simple valve which is biased by the spring 14. As the foot is raised, a vacuum is created by the expansion of the interior of the shoe, whereby the air valve 15 is closed and the fresh air is displaced in the interior of the shoe through the air inlet 3, through the channels 6, 6', and 7, and through apertures 8. Thus the flow of fresh air into the interior of the shoe with every step taken by the wearer functions to keep the foot dry and cool, thereby inhibiting the formation of foot fungi and other foot diseases, the inner sole 27 also provides a cushioning effect to the wearer which reduces the amount of body shock produced by walking.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A ventilating system for a shoe, which comprises:

an upper of the shoe, said upper including an air inlet and an air outlet disposed in the upper portion thereof, said air inlet and said outlet being provided with a pair of raised portions disposed in parallel for freely passing a shoelace between the pair of raised portions so as to close the inlet and the outlet, respectively, an one-way air flowing member disposed in the lower portion of said upper, said one-way air flowing member including a hollow body with a plurality of air flowing apertures, a spring with an air valve, and a cover with a hole whereby the air valve is slidably moved forwardly and backwardly between the hollow body and the cover so as to control the discharge and stop of ambient air from the interior of the shoe, an air inlet vertical plate member attached to the inner surface of said upper, said air inlet vertical plate member including air inlet flowing means for communicating the air inlet with the interior of the shoe, said air inlet flowing means including a plurality of inlet channels, a plurality of inlet cross channels, a plurality of inlet radial channels, and a plurality of inlet apertures of the air inlet vertical plate member, an air outlet vertical plate member attached to the inner surface of said upper, said air outlet vertical plate member including air outlet flowing means for communicating the air outlet with the interior of the shoe through the one-way air flowing member, said air outlet flowing means including a plurality of outlet channels, a plurality of outlet cross channels, a plurality of outlet radial channels, and said one-way air flowing member, and an insole having a plurality of insole apertures and an arch extended portion for mating with the one-way air flowing member and a plurality of air discharging channels disposed in the bottom thereof, whereby when pressure is applied to the insole, air is expelled from the interior of the shoe through the air valve into the air outlet through the air outlet flowing means and when the pressure is released from the insole, air is drawn in the interior of the shoe and the air valve to close in order to introduce fresh air from the air inlet through the air inlet flowing means.

2. The ventilating system of claim 1, wherein the air inlet and the air outlet are disposed in an air outlet body and an air inlet body which are attached to the outer side and the inner side of the interior of the upper portion of the upper of the shoe by sewing, respectively.

3. The ventilating system of claim 1, wherein the air valve of the one-way air flowing member has a circular configuration with a ring edge.

4. The ventilating system of claim 3, the cover of the one-way air flowing member is provided with a raised ring extended from the cover for receiving the air valve and inserting into a circular slot of the hollow body.

5. The ventilating system of claim 1, wherein the arch extended portion is provided with a stopping raised portion for returning air to the air inlet flowing means.

* * * * *